US006364245B1

(12) United States Patent
Paal et al.

(10) Patent No.: US 6,364,245 B1
(45) Date of Patent: Apr. 2, 2002

(54) TOILET ROLL DISPENSER FOR DIFFERENT DIAMETER CORE ROLLS

(75) Inventors: Alan P. Paal, New Franken; Alan J. Pierquet, Green Bay, both of WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 0 days.

(21) Appl. No.: 09/536,790

(22) Filed: Mar. 28, 2000

(51) Int. Cl.[7] ..... B65H 19/00

(52) U.S. Cl. ..... 242/560; 242/597.8; 225/38; 225/77

(58) Field of Search ..... 242/560, 597.6, 242/597.8; 312/34.22; 225/37, 38, 46, 77

(56) References Cited

U.S. PATENT DOCUMENTS

| | | | |
|---|---|---|---|
| 4,260,117 | A | 4/1981 | Perrin et al. |
| 4,375,874 | A | 3/1983 | Leotta et al. |
| 4,422,584 | A | 12/1983 | Dashnier et al. |
| 4,422,585 | A | 12/1983 | Schultz et al. |
| 4,520,968 | A | 6/1985 | Shpigelman |
| 4,564,148 | A | 1/1986 | Wentworth |
| 4,662,577 | A | 5/1987 | Lewis |
| 4,697,754 | A | 10/1987 | Duff |
| 4,756,485 | A | 7/1988 | Bastain et al. |
| 4,773,608 | A | 9/1988 | Quackenbush |
| 4,807,823 | A | 2/1989 | Wyant |
| 4,844,361 | A | 7/1989 | Granger |
| 4,872,601 | A | 10/1989 | Sigmund |
| 4,944,466 | A | 7/1990 | Jespersen |
| 4,998,681 | A | 3/1991 | McNeill |
| 5,265,816 | A | 11/1993 | Collins |
| 5,302,167 | A | 4/1994 | Kley et al. |
| 5,310,129 | A | 5/1994 | Whittington et al. |
| 5,449,127 | A | 9/1995 | Davis |
| 5,601,253 | A | 2/1997 | Formon et al. |
| 5,628,474 | A | 5/1997 | Krueger et al. |
| 5,636,812 | A | 6/1997 | Conner et al. |
| 5,645,244 | A | 7/1997 | Moody |
| 5,669,576 | A | 9/1997 | Moody |
| D384,531 | S | 10/1997 | Mervar et al. |
| 5,813,624 | A | 9/1998 | Grasso et al. |
| 5,868,342 | A | 2/1999 | Moody et al. |

*Primary Examiner*—John Q. Nguyen
(74) *Attorney, Agent, or Firm*—Emrich & Dithmar

(57) ABSTRACT

A dispenser for selectively dispensing first and second rolls of sheet material respectively wrapped around first and second cores is provided. The dispenser includes a housing defining a storage compartment for the first and second rolls and an opening, a first and second core support structures disposed in the housing for respectively supporting differently sized first and second cores and a divider slidably carried by the housing and covering a portion of the opening. The divider is movable between a first dispensing position, wherein a first portion of the opening is uncovered to allow access to the first roll and a second portion of the opening is covered to prevent access to the second roll, and a second position, wherein the first portion of the opening is covered and the second portion the opening is uncovered to allow access to the second roll. The divider includes an adjustable blocking plate for preventing movement of the divider from the first dispensing position to the second dispensing portion until substantially all the sheet material has been exhausted from the first roll. The plate is positionable on the divider in a plurality of positions relative to the first core support structure to compensate for different diameter cores.

13 Claims, 14 Drawing Sheets

TOILET ROLL DISPENSER FOR DIFFERENT DIAMETER CORE ROLLS

BACKGROUND OF THE INVENTION

1. Field of the Invention

This invention relates generally to dispensers for rolls of sheet material, and more particularly, to toilet roll dispensers.

2. Description of the Prior Art

In the past, dispensers have been provided for dispensing rolls of sheet material, such as, toilet paper. These dispensers normally had a housing which could house at least two rolls of toilet tissue. These dispensers however, suffered from the fact that they could only dispense toilet tissue rolls of a single given size diameter core. This thus, required a plurality of different dispensers to be used, one for each different diameter size core.

Additionally, there have been toilet roll dispensers housing two rolls of toilet paper which included blocking structure to prevent the dispensing of the second roll of toilet tissue prior to the exhaustion of the first roll of toilet tissue of the first roll. These blocking devices, however, were often very complicated and costly to make.

SUMMARY OF THE INVENTION

It is the general object of the invention to provide an improved tissue roll dispenser to overcome the disadvantages of prior tissue roll dispensers while affording additional structural and operating advantages.

An important feature of the invention is provision of a dispenser which is a relatively simple and economical construction.

Another feature of the invention is provision of a dispenser of a type set forth which has the ability to dispense sheets of tissue, from rolls having cores of various diameters.

A still further feature of the invention is the provision of a dispenser of the type set forth which prevents access to the second roll of toilet tissue until the first roll has been substantially exhausted.

Certain ones of these and other features of the invention may be obtained by providing a dispenser for selectively dispensing first and second rolls of sheet material respectively wrapped around first and second cores. The dispenser includes a housing defining a storage compartment for the first and second rolls and an opening, first and second core support structures disposed in the housing for respectively supporting differently sized first and second cores and a divider slidably carried by the housing and covering a portion of the opening. The divider is movable between a first dispensing position, wherein a first portion of the opening is uncovered to allow access to the first roll and a second portion of the opening is covered to prevent access to the second roll, and a second position, wherein the first portion of the opening is covered and the second portion opening is uncovered to allow access to the second roll. The divider includes an adjustable blocking plate for preventing movement of the divider from the first dispensing position to the second dispensing portion until substantially all the sheet material has been exhausted from the first roll. The plate is positionable on the divider in a plurality of positions relative to the first core support structure to compensate for different diameter cores.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated

DETAILED DESCRIPTION OF THE PREFERRED EMBODIMENTS

Figure 1:
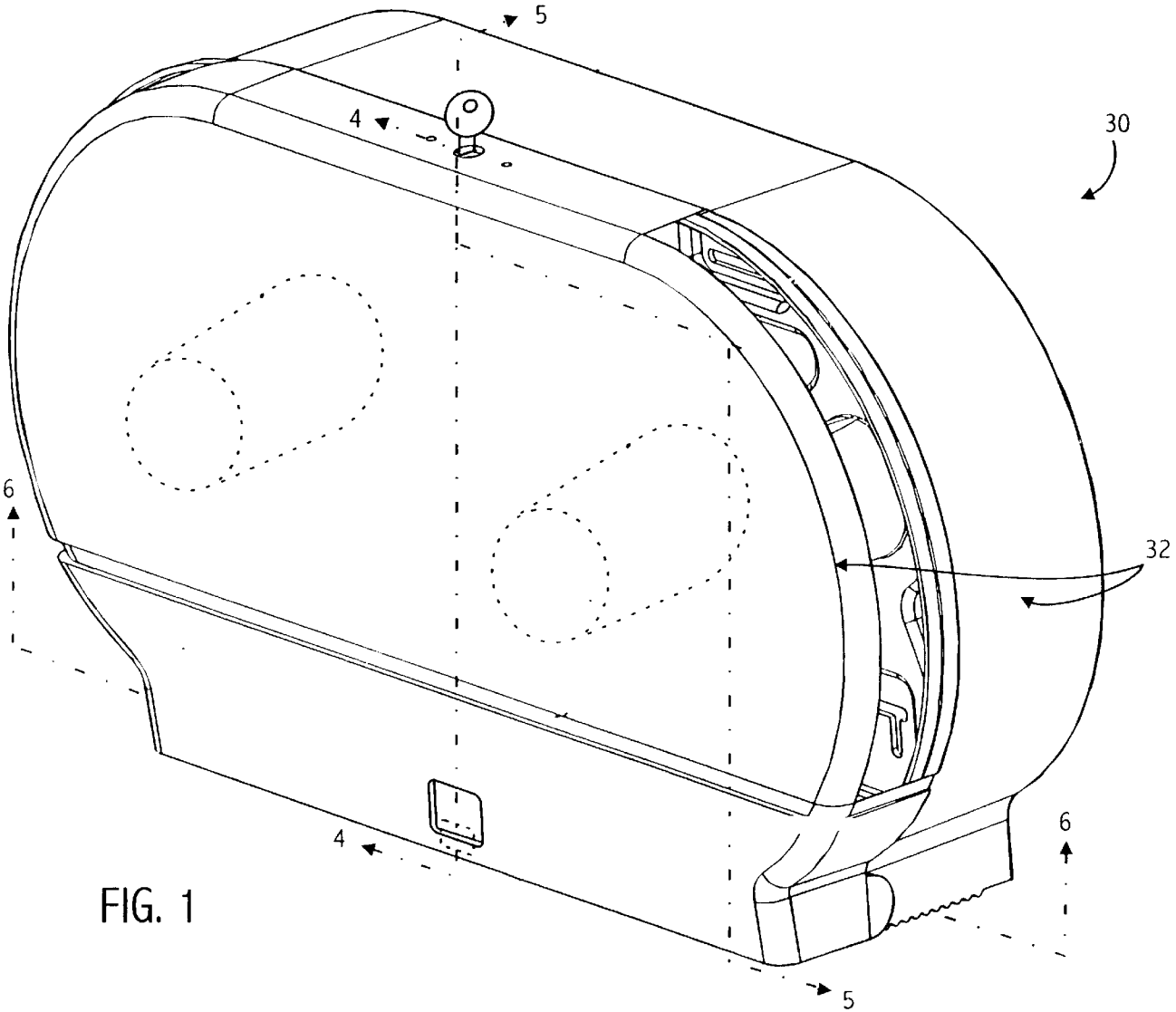
FIG. 1 is a perspective view a toilet roll dispenser in occurrence with the present invention.
Figure 2:
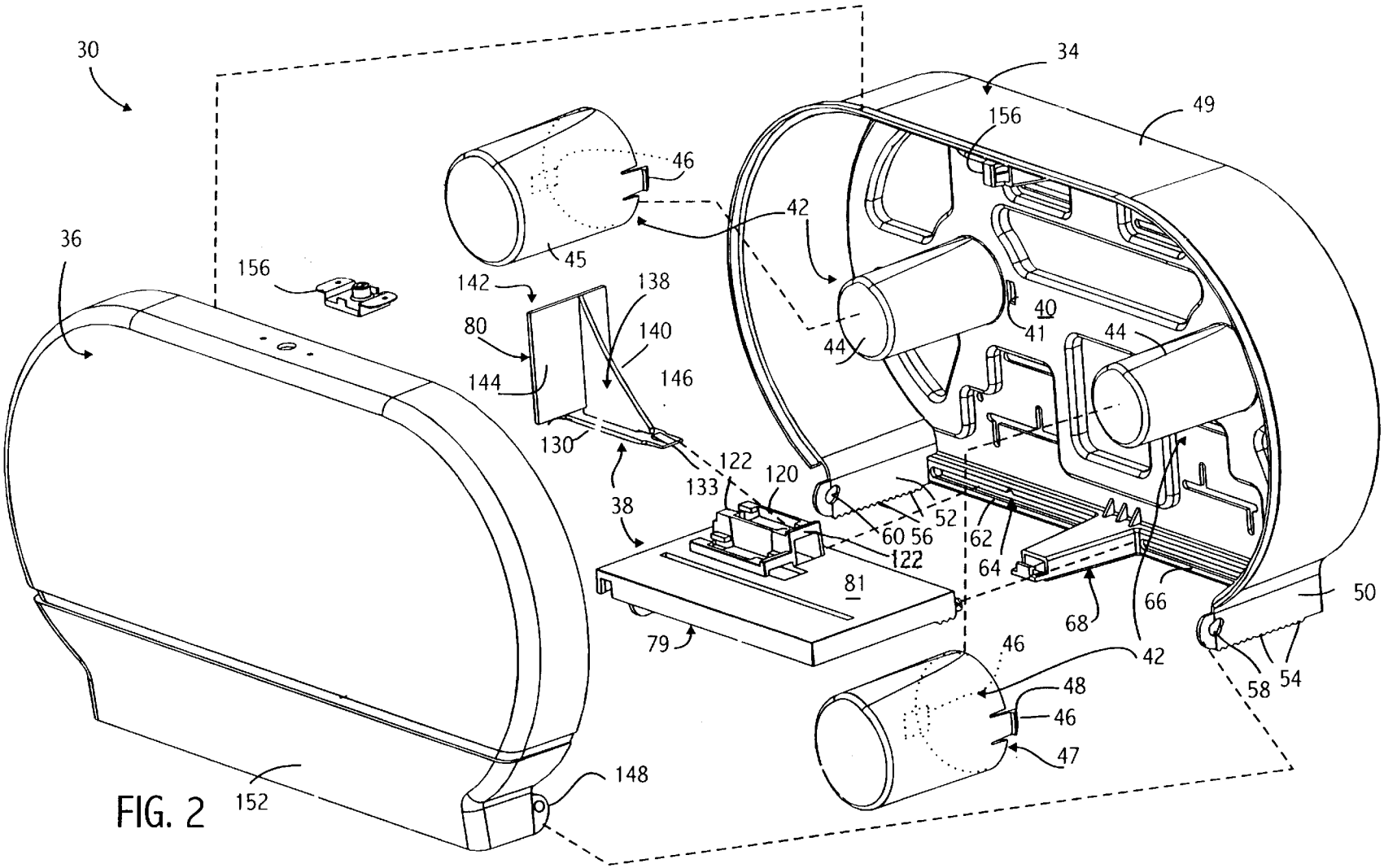
FIG. 2 is an exploded perspective view of the dispenser of FIG.1.
Figure 3:
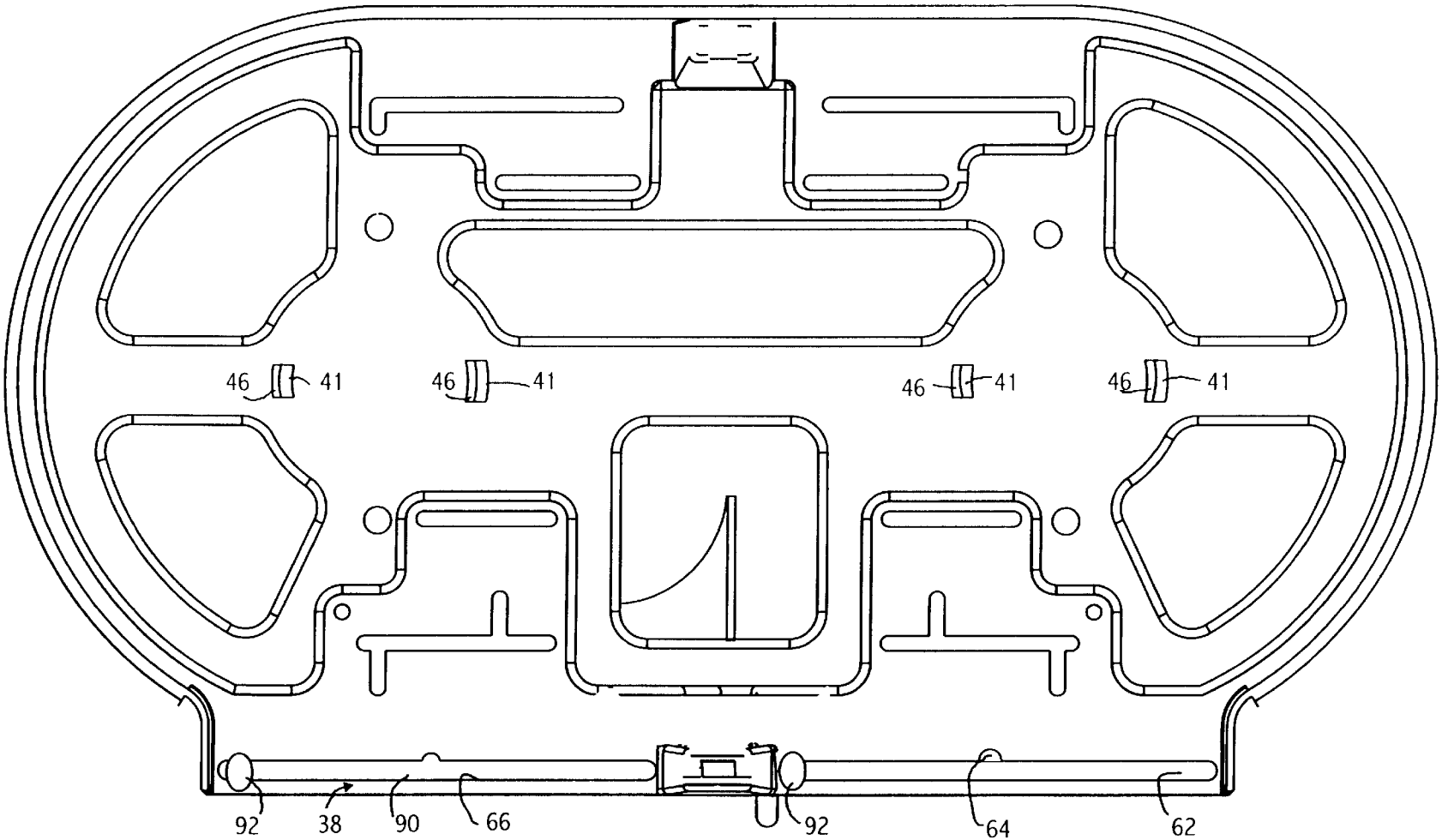
FIG. 3 is a rear elevation view of the dispenser of FIG. 1.
Figure 6:
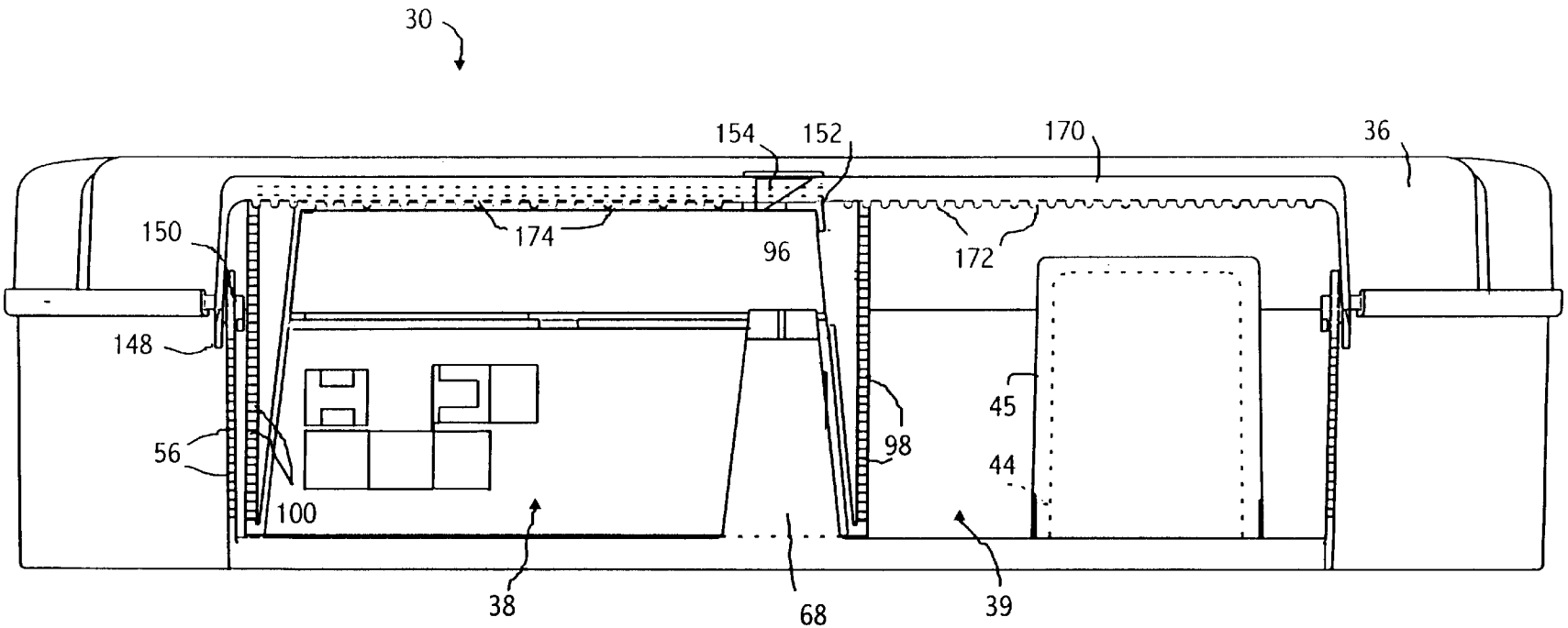
FIG. 6 is a bottom plan view of the dispenser of FIG. 1, with a portion of the bottom wall of the cover partially broken away.
Figure 7:
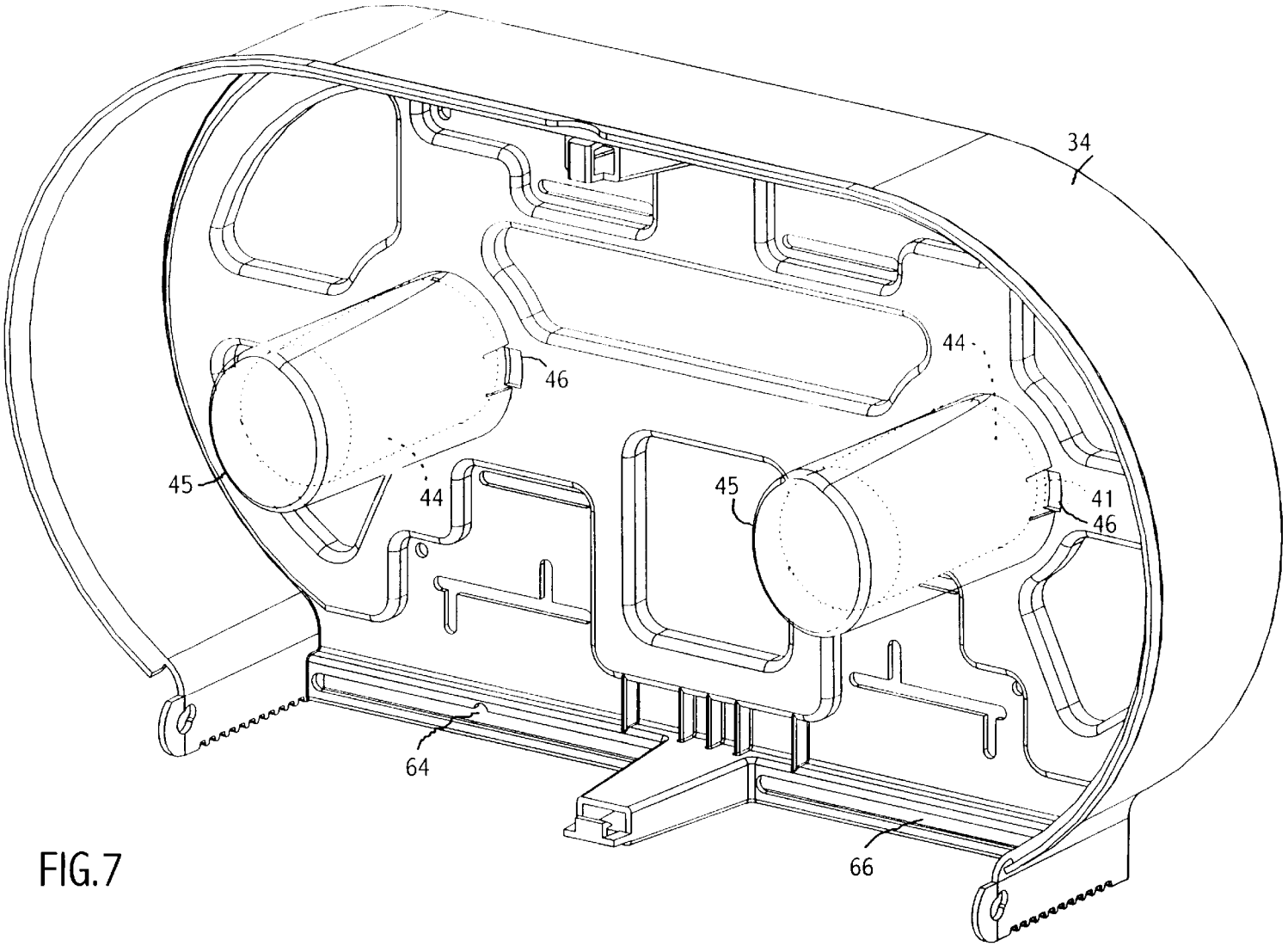
FIG. 7 is a perspective view of the body of the housing of the dispenser of FIG. 1.

Referring to FIG. 1, a multi-roll toilet tissue dispenser 30 is illustrated. Referring to FIG. 2 the toilet roll dispenser 30 includes a body 34, a cover 36 and a divider 38. The body 34 and cover 36 form a housing 32 defining a storage compartment for the toilet tissue rolls and an opening 39 (FIG. 6). The body 34 includes a back wall 40 having four apertures 41 (FIGS. 3 and 7) and a core support structure 42 coupled to the back wall 40 in use. The core support structure 42 is adaptable to be used with at least two different diameter cores of toilet roll tissue. In that respect, the core support structure 42 includes two generally cylindrical, smaller diameter, core supports 44 which project from and are integral with the back wall 40. Each of the smaller diameter core supports 44 is disposed between an associated pair of apertures 41. The core support structure 42 can be used to support cores of tissue paper having a diameter such as 2.25 inches. The core support structure 42 also includes two generally cylindrical larger diameter core supports 45. Each of the larger diameter core supports 45 include two diametrically opposed tabs 46. The tabs 46 respectively include a triangular end 47 and a shoulder 48. The larger diameter core supports 45 are formed preferably of a resilient material and the tabs 46 are resiliently biased radially outward. When the core support structure 42 is used to support larger diameter cores of tissue paper (such as those with 3 inch diameters), the larger diameter core supports 45 are each coupled to the back wall 40 of the body 34 to support the core of tissue paper by inserting its tabs 46 through associated apertures 41 in the back wall 40, (FIGS. 3 and 7) in a known manner.

The body 34 also includes a part oval peripheral wall 49 coupled to the back wall 40. The oval wall 49 defines two side plates 50, 52 at its terminal ends. The side plates 50, 52 are disposed at opposite longitudinal ends of the housing 32 and are generally parallel to one another and respectively include sets of teeth 54, 56. The side plates 50, 52 also respectively include an aperture 58, 60.

The back wall 40 also defines a first slot 62 communicating with an upper notch 64 disposed at the center of the first slot 62 and a second slot 66 aligned with the first slot 62. The body 34 also includes a divider support 68 projecting from the back wall 40 and disposed between the first and second slots 62, 66. The divider support 68 has a terminal end 70 defining a slot 72 formed by a bottom wall 74, a front flange 76, and a triangular top flange 78.

Figure 4:
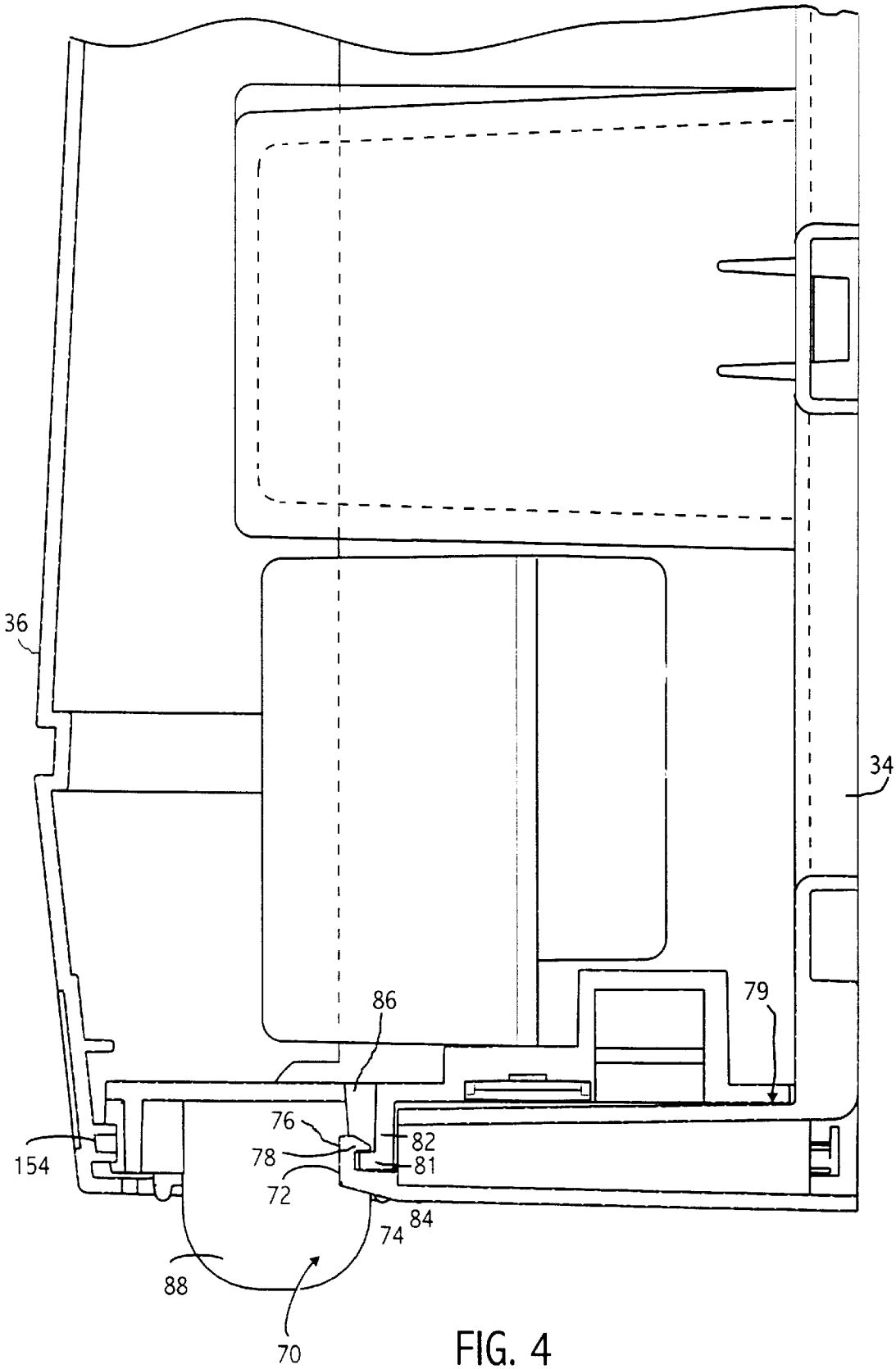
FIG. 4 is a sectional view taken generally along the line 4—4 of FIG. 1.
Figure 8:
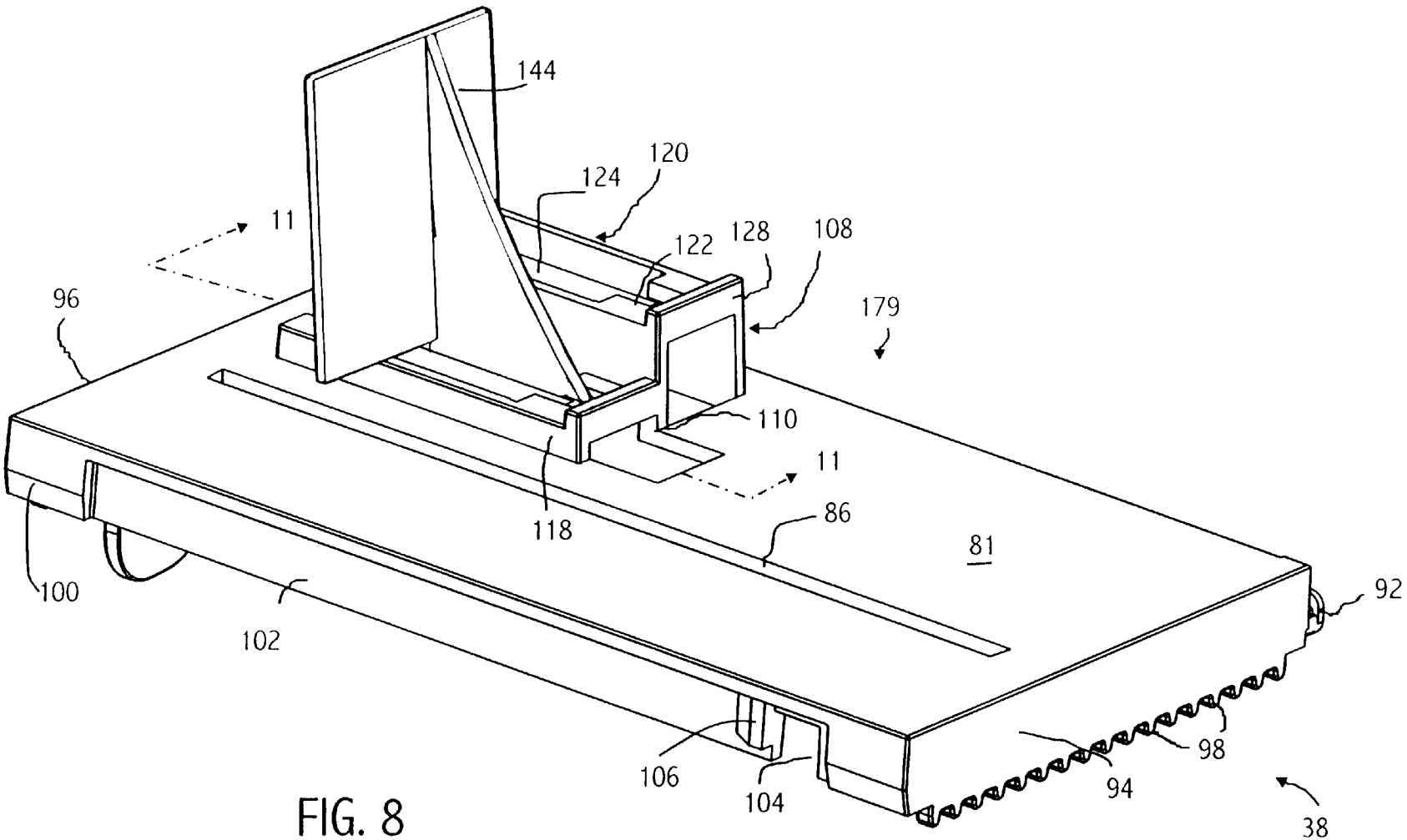
FIG. 8 is a perspective view of the divider of the dispenser of FIG. 1.
Figure 9:
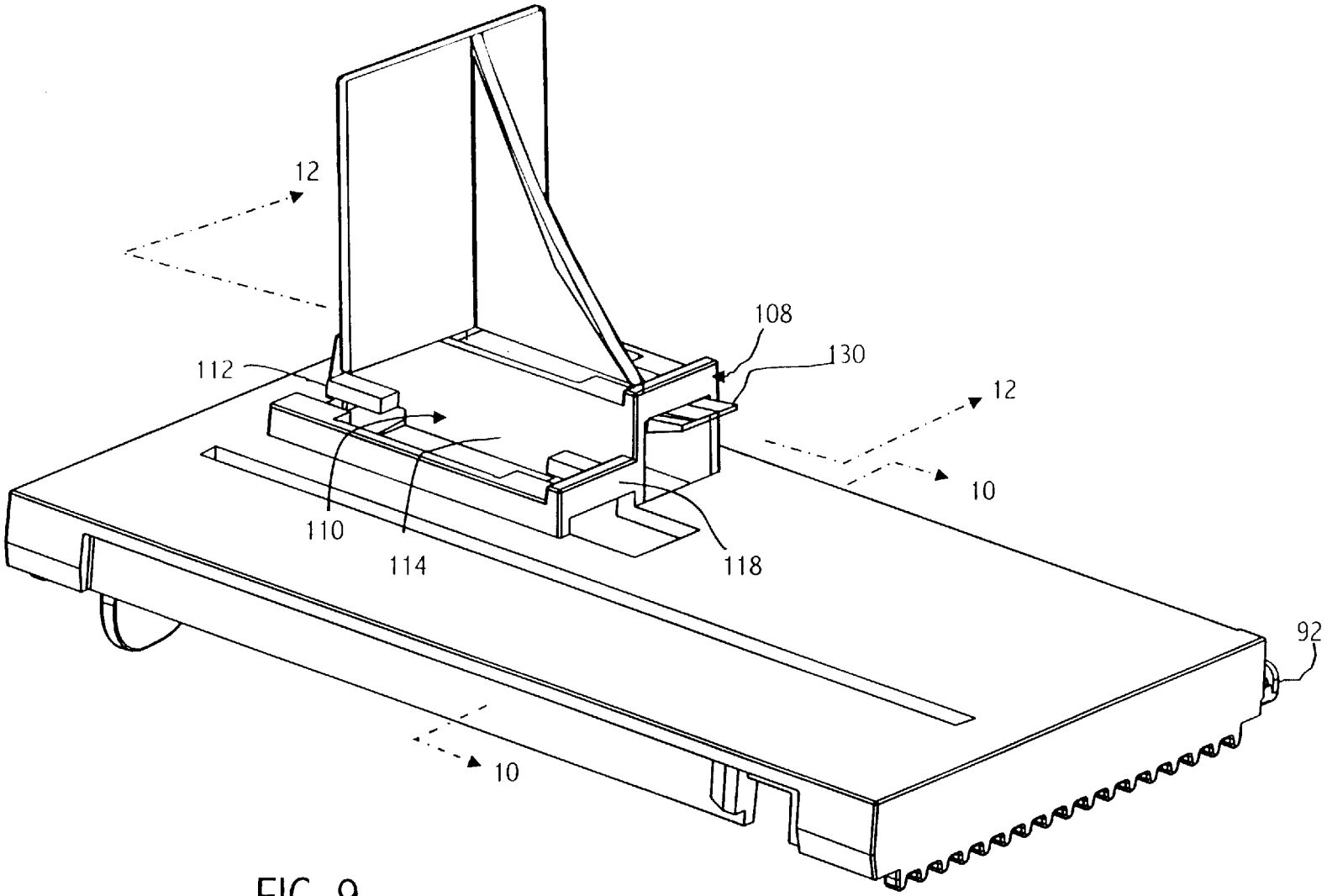
FIG. 9 is a view similar to FIG. 9 where the blocking plate of the divider has been positioned in the upper position of the adapter of the divider.
Figure 11:
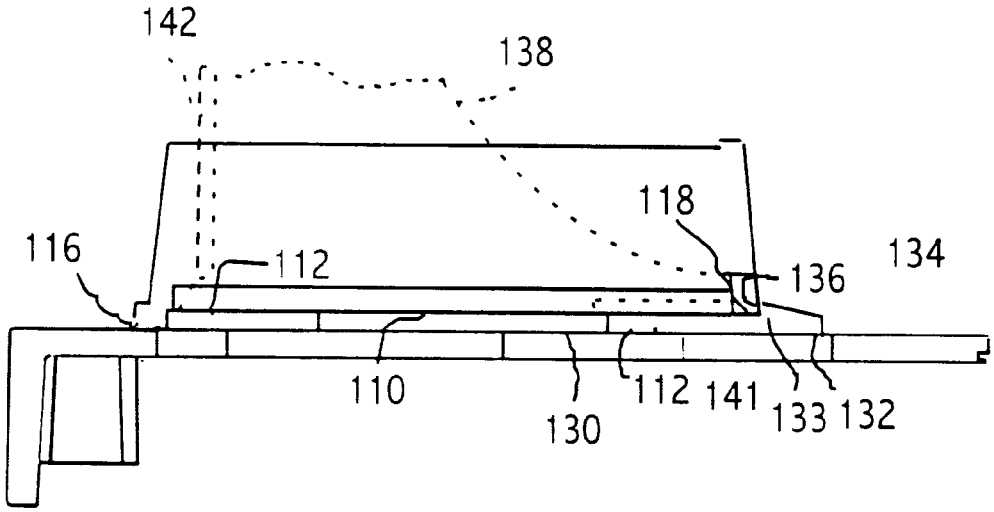
FIG. 11 is a fragmentary, sectional view taken generally along line 11—11 of FIG. 8 with the upper walls of blocking plate shown in dashed line for clarity.
Figure 12:
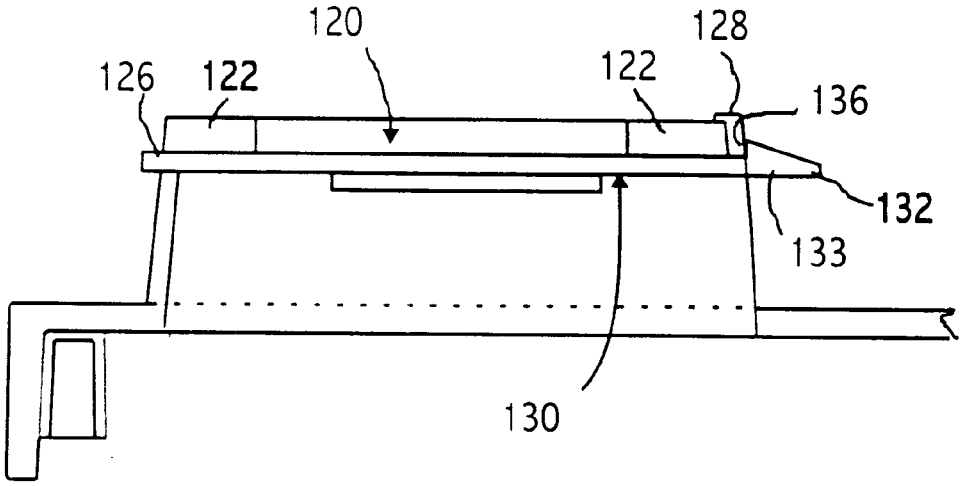
FIG. 12 is a sectional view similar to FIG. 11 taken generally along the line 12—12 of FIG. 9, without the upper walls of the blocking plate.

As seen in FIG. 2, the divider 38 includes a roll plate 79 and a blocking plate 80 coupleable to the roll plate 79 in a plurality of positions. The roll plate 79, as seen in FIG. 2, includes a base wall 81 and, as best seen in FIG. 4, a flange 82 depending at a right angle from the base wall 81 and a second flange 84 perpendicularly projecting from the flange 82 and disposed generally parallel to the base wall 81. The base wall 81 defines a slot 86 disposed in front of the flange 82. The roll plate 79 also includes a grip 88 depending from the base wall 81 and a truncated rear wall 90 coupled to the base wall 81 and having two tabs 92 projecting rearwardly therefrom. Referring to FIG. 8, the roll plate 79 also includes generally parallel side walls 94, 96 depending from the base wall 81 and respectively having teeth 98, 100 running along its entire length. The roll plate 79 also includes a front wall 102 defining a slot 104 and a ramp 106 projecting from the front wall 102 adjacent the slot 104. The roll plate 79 also includes an adapter 108 having, as seen in FIGS. 2 and 9, a lower receptacle 110 defined by four top wall portions 112, and a base wall 114. The top wall portions 112 and the base wall 114 form a slot 116 (FIG. 11). The lower receptacle 110 also includes a side wall 118. The adapter also includes, as seen in FIG. 8, an upper receptacle 120 spaced above the lower receptacle 110. The upper receptacle 120 is formed by four top wall portions 122 and a base wall 124. Together the top wall portions 122 and the base wall 124 form a slot 126 (FIG. 12). The upper receptacle 120 also includes a side wall 128.

Figure 16:
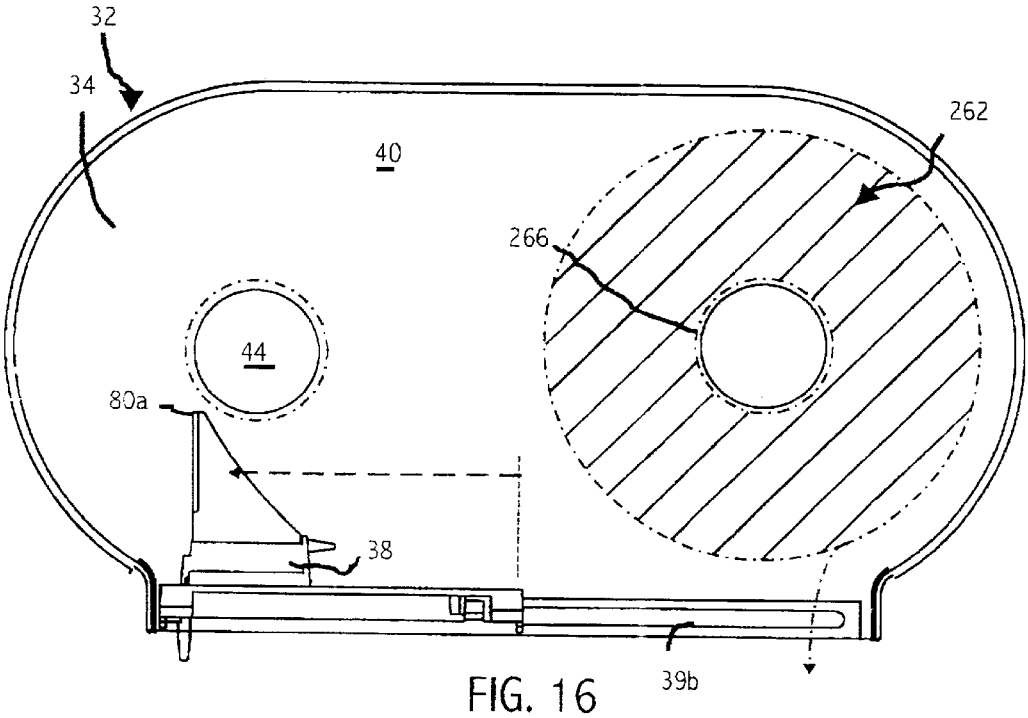

Referring to FIG. 16, the blocking plate 80 includes an insertion flange 130 having a terminal end 132 having a triangular tab 133 which forms a cam surface 134 and a shoulder 136. As seen in FIG. 2, the blocking plate 80 also includes a wall 138 coupled to and generally bisecting the insertion flange 130. The wall 138 includes an arcuate edge 140. The wall 138 and insertion flange 130 form a small slot 141 (FIG. 11) therebetween. The blocking plate 80 also includes a blocking wall 142 coupled to the wall 138. The blocking wall 142 includes a larger area portion 144 and a smaller area portion 146 on respective sides of the wall 138. The smaller area portion is smaller in both length and width. The blocking plate 80 is inserted into either the upper or lower receptacle 110 or 120 depending upon the diameter of the tissue paper core being supported by the core support structure 42. When a larger diameter core is supported on the core support structure 42, the insertion flange 130 (as seen in FIGS. 8 and 11), is disposed in the slot 116 of the lower receptacle 110 such that the terminal end 132 is disposed outside the slot 116 such that the shoulder 136 of the tab 133 abuts and is trapped by wall 118. In this position, the smaller area portion 146 is disposed above the upper receptacle 120 without any interference therewith, due to its smaller dimensions.

Similarly, as seen in FIGS. 9 and 12, when a smaller diameter core is supported on the core support structure 42, the insertion flange 130 is disposed in slot 126 of the upper receptacle 120 such that the shoulder 136 of the tab 133 abuts the wall 128 of the upper receptacle 120.

Figure 10:
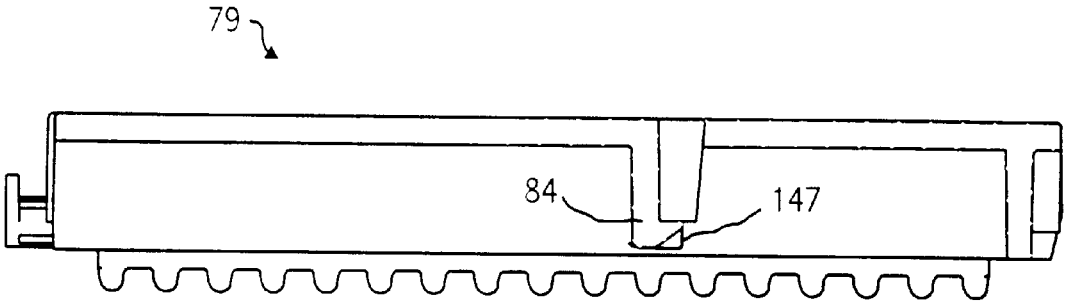
FIG. 10 is a sectional view taken generally along line 10—10 of FIG. 9.

The divider 38 is coupled to and slidably supported on the body 34 as follows. One of the tabs 92 is aligned with the upper notch 64 of the first slot 62. The tabs 92 of the divider 80 are then respectively inserted into the first and second slots 62, 66 of the back wall 40 of the body 34. The flange 84 has a narrower inclined central portion 147 (FIG. 10) which is then snapped into the slot 72 of the divider support 68. Under certain conditions, the divider 38, as discussed further below, is slidable in the slots 62, 66 and 72 between first and second dispensing positions by a user gripping and moving the grip 88.

Figure 5:
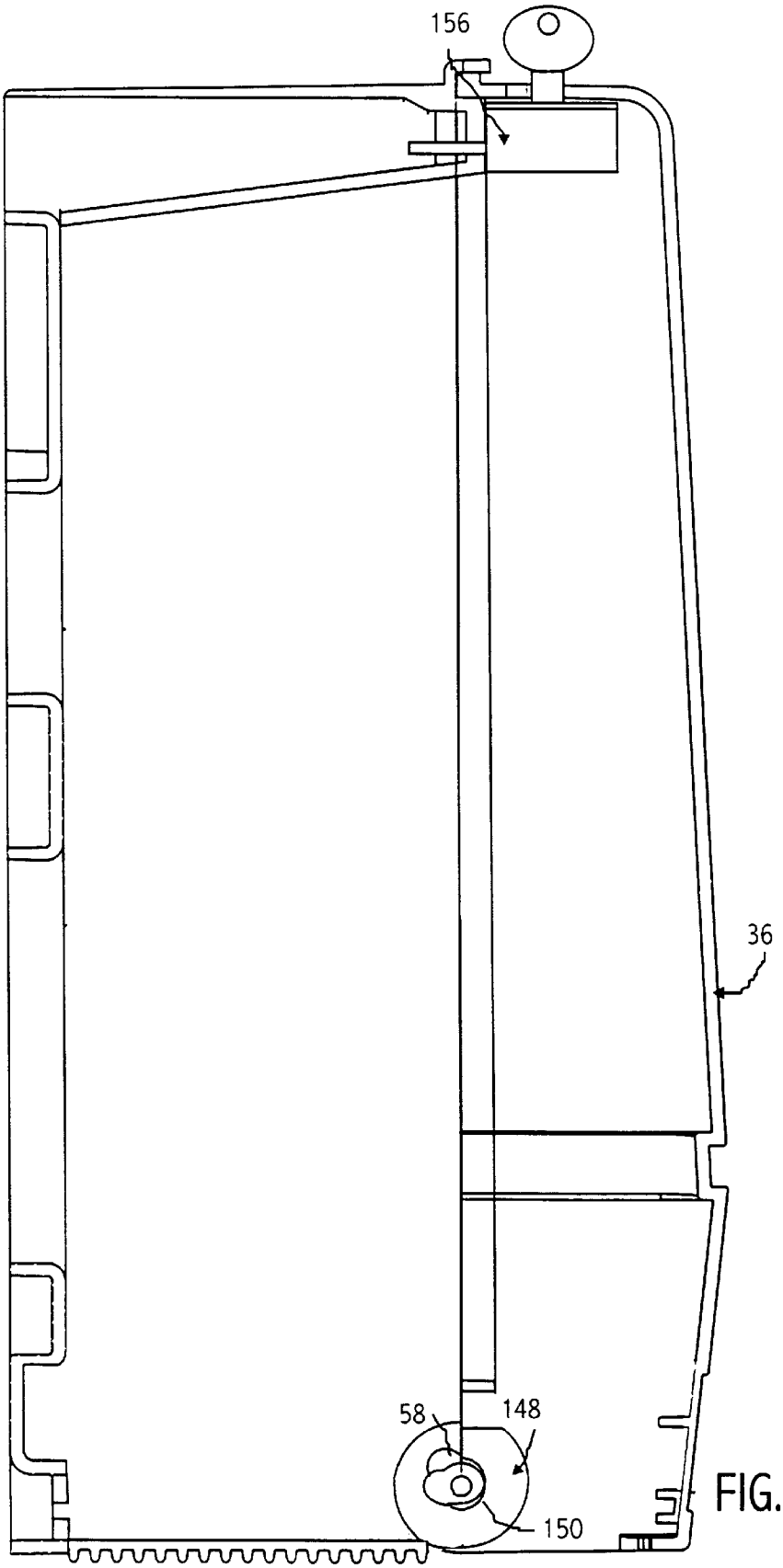
FIG. 5 is a sectional view taken generally along the line of 5—5 of FIG. 1.

Referring to FIGS. 2, 5 and 6, the cover 36 includes two arcuate tabs 148 respectively having a projection 150 projecting inwardly (FIG. 5). The tabs 150 are respectively disposed in apertures 58 and 60 of plates 50 and 52 of the body 34 to pivotally couple the cover 36 to the body 34. The cover 36 also includes a front wall 152 having a locking tab 154 projecting inwardly at the center of the front wall 152 (FIGS. 4 and 6). The cover 36 and the body 34 each include mating locking structure 156 (FIG. 2) for keeping the cover 36 locked to the body 34, in a known manner.

Figure 13:
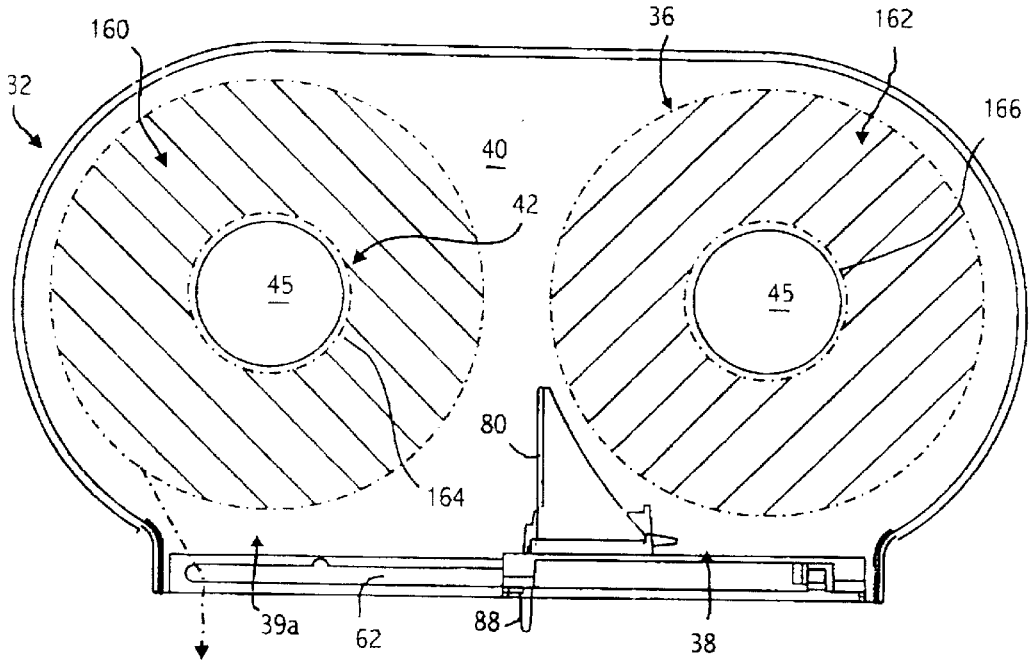
FIGS. 13 and 14 are schematic views illustrating how the divider prevents access to one of the first or second rolls.
Figure 14:
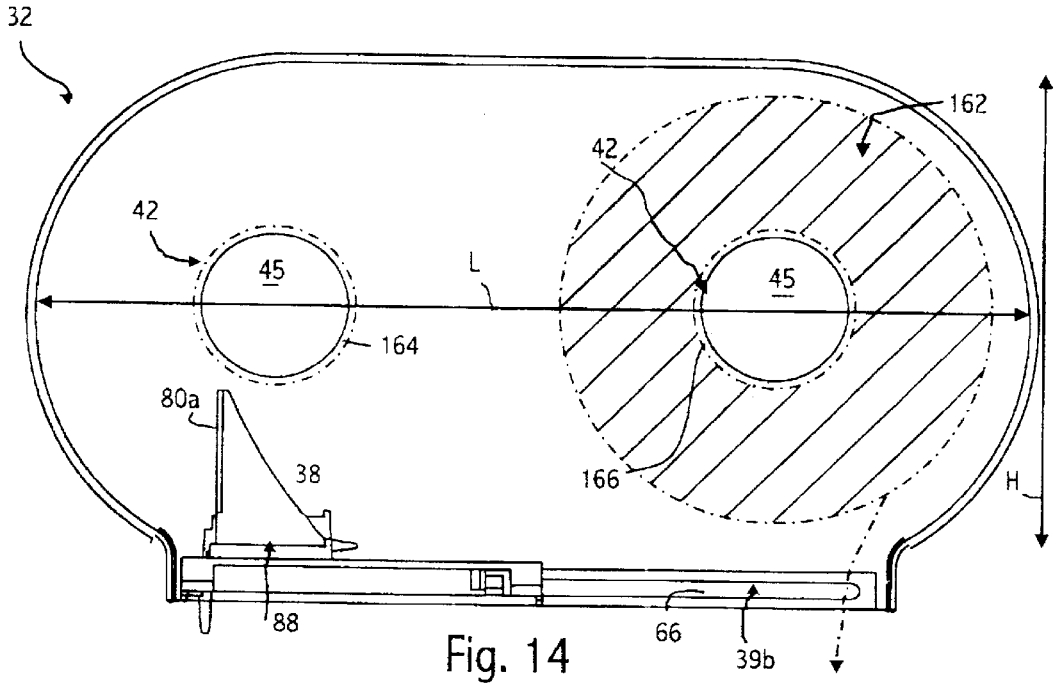

Referring to FIGS. 13 and 14, the housing 32 has a length, l, as measured along a line passing through the centers of both core supports (44 or 45) of core support structure 42 and a height ,h, transverse to the length. The slots 62 and 66 run along the length of the housing 32 and the height is perpendicular thereto. As seen in FIGS. 13 and 14, the dispenser 30 is supporting first and second rolls of toilet tissue paper 160, 162 disposed about larger diameter cores 164, 166. In this mode, the larger diameter core supports 45 are coupled to the back wall 40 of the body 36 and the blocking plate 80 is disposed in the lower receptacle 110 of the adapter 108 of the roll plate 79, as seen in FIG. 8.

As seen in FIG. 13, the divider 38 is in a first dispensing position covering a portion **39*b* of the opening 39 directly under the second roll 162 and the associated core support structure 42 and leaving a portion 39*a* of the opening 39 uncovered. In the first dispensing position, access by a user to the second roll 162 is prevented while access to the first roll 160 to dispense toilet tissue out of portion 39*a* is allowed. The blocking plate 80 has an upper portion 80*a*** which is disposed along the height of the dispenser such that when toilet tissue remains on the first core 164, the upper portion 80*a* of the blocking plate 80 will contact the remaining tissue and the divider 38 cannot be slid along the length of the dispenser to a second dispensing position, as seen in FIG. 14, where the divider 38 is located directly under the core 164 and the associated core support structure 42 and covers portion 39*a* of the opening 39. In this position, access is allowed the second roll 162, as portion 139*b* of the opening 139 remains uncovered. In this regard, the upper portion 80*a* of the blocking plate 80 is disposed at substantially the same position along the height of the housing 32 as the lowermost portion of the larger diameter core support 45 which together prevent the divider from being slid under the core support 45 to the second dispensing position until substantially all the sheet material from the first roll 160 is exhausted. When the divider 38 is in the second dispensing position, as seen best in FIG. 6, the locking tab 154 is disposed in the slot 96 of the divider 38 which maintains the divider 38 in the second dispensing position until enough force is exerted by a user to move the divider 38 from its second dispensing position.

Figure 15:
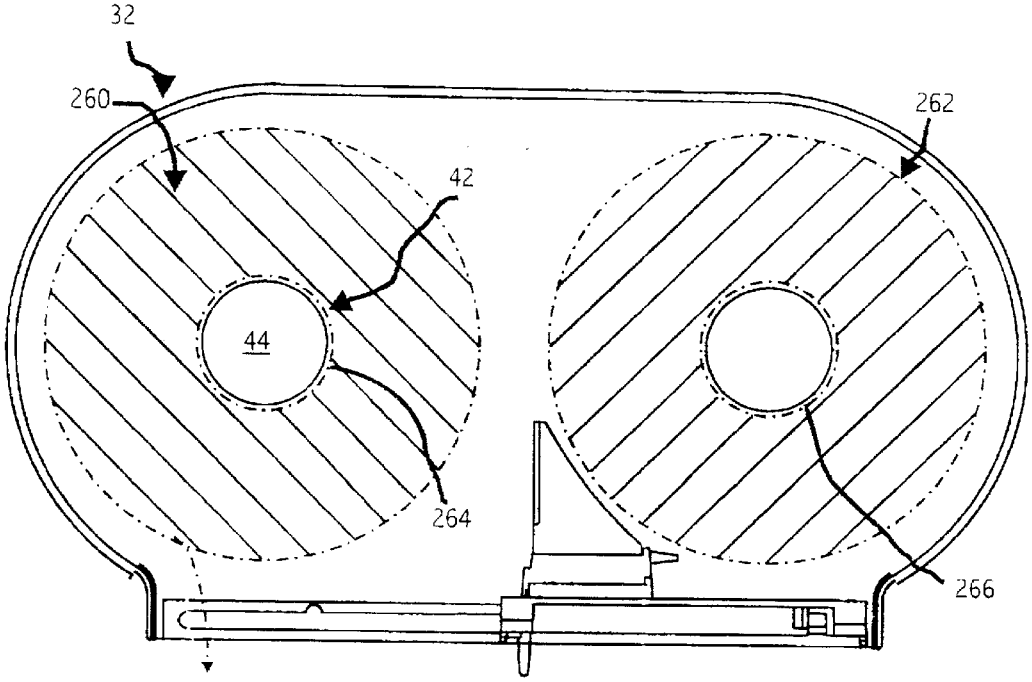
FIGS. 15 and 16 are views similar to FIGS. 18 and 19 illustrating how the divider is used for rolls having smaller diameter cores.

Referring to FIGS. 15 and 16, the dispenser 30 is disposed in a mode for supporting first and second rolls of toilet tissue paper 260, 262 disposed about smaller diameter cores 264, 266. In this mode, the larger diameter core supports 45 are removed from the back wall 40 of the body 34 and the first and second rolls 260, 262 are supported on the smaller diameter core supports 44. Also in this mode, the blocking plate 80 is disposed in the upper receptacle 120 of the adapter 108 of the role plate 79, as seen in FIG. 9. This places the upper portion 80*a* of the blocking plate 80 at a higher height so that it is disposed at substantially the same position along the height of the housing 32 as the lowermost portion of the smaller diameter core support 44 to prevent movement of the divider 38 from the first dispensing position to the second dispensing position in the same manner as discussed with respect to FIGS. 13 and 14 above.

Figure 17:
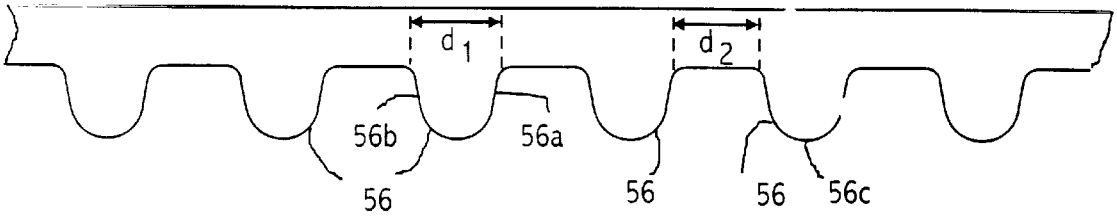
FIG. 17 is an enlarged fragmentary side elevational view of the teeth of the body.
Figure 18:
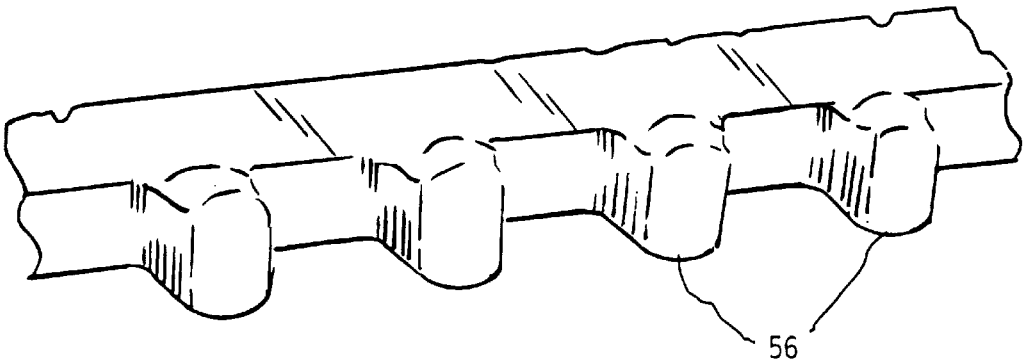
FIG. 18 is an enlarged perspective view of the teeth of FIG. 17.

As seen in FIG. 6, the cover has a bottom wall 170 having first and second sets of teeth 172, 174 perpendicularly disposed to the teeth 54, 56, 98, 100. This allows the first and second opening portions 39*a* and 39*b* to be substantially surrounded by teeth on three sides. Referring to FIGS. 17 and 18, each of the teeth 56 has two sides 56*a*, 56*b* and a maximum width, $d_1$, as defined by the maximum distance between the sides 56*a*, 56*b*. Each of the teeth 56 is spaced from adjacent teeth 56 by a distance, $d_2$. Preferably $d_2$ is substantially equal to $d_1$. Additionally, each tooth 56 has a rounded peak 56*c*. This shaping and spacing allows the toilet roll tissue being cut to be properly snagged on a teeth 56 and prevents a user from cutting or poking his hand (as often occurs with the prior saw tooth configurations). Preferably all the teeth 56, 58, 98, 100, 172 and 174 are identically spaced and shaped.

While particular embodiments of the present invention have been shown and described, it will be appreciated by those skilled in the art that changes and modification may be made without departing from the invention in its broader aspects. Therefore the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A dispenser for selectively dispensing first and second rolls of sheet material respectively wrapped around first and second cores, the dispenser comprising:

a housing defining a storage compartment for the first and second rolls and an opening;

first and second core support structures disposed in the housing for respectively supporting differently sized first and second cores; and a divider slidably carried by the housing and covering a portion of the opening, the divider movable between a first dispensing position, wherein a first portion of the opening is uncovered to allow access to the first roll and a second portion of the opening is covered to prevent access to the second roll, and a second dispensing position, wherein the first portion of the opening is covered and the second portion the opening is uncovered to allow access to the second roll, the divider including an adjustable blocking plate for preventing movement of the divider from the first dispensing position to the second dispensing portion until substantially all the sheet material has been exhausted from the first roll, the plate positionable on the divider in a plurality of positions relative to the first core support structure to compensate for different diameter cores.

2. The dispenser of claim 1, wherein the housing includes a length and a height, the first core support structure disposed at a first core position along the height, the divider being slidable along the length and having mounting apparatus for varying the distance along the height between the plate and the first core support structure.

3. The dispenser of claim 2, wherein the divider includes an adapter having first and second slots respectively disposed at spaced apart first and second slot positions along the height of the housing, the blocking plate positionable in one of the first and second slots.

4. The dispenser of claim 3, wherein a portion of the blocking plate and a portion of a first core support structure are disposed at substantially the same position along the height.

5. The dispenser of claim 1, wherein the first and second core support structures respectively include first larger and smaller diameter core supports and second larger and smaller diameter core supports, wherein the first and second smaller diameter core supports are fixed to the housing and the first and second larger diameter core supports are removably mounted to the housing.

6. The dispenser of claim 1, wherein the divider has first and second ends respectively having first and second teeth, each of the first and second teeth having two sides connected by a peak, wherein when the divider is in the first position, the second teeth are engageable with the sheet material from the second roll of sheet material, and when the divider is in the second position, the first teeth are engageable with the sheet material from the first roll of sheet material.

7. The dispenser of claim 6, wherein each of the first teeth has a first maximum width defined by the maximum distance between the sides of the tooth and is spaced from adjacent first teeth by a distance substantially equal to the first maximum width.

8. The dispenser of claim 7, wherein each of the second peak teeth has a second maximum width defined by the maximum distance between the sides of the tooth and is spaced from adjacent second teeth by a distance substantially equal to the second width.

9. The dispenser of claim 8, wherein the peak of each of the first and second teeth is rounded.

10. The dispenser of claim 9, wherein the latch includes a tab projecting from one of the housing and the divider and a slot disposed in the other of the housing and the divider for receiving the tab.

11. The dispenser of claim 6, wherein the housing has first and second longitudinal ends respectively having first and second housing teeth extending transversely to the length of the housing and respectively engageable with the sheet material from the first and second rolls of sheet material.

12. The dispenser of claim 11, wherein each of the first and second housing teeth each has a maximum width and is spaced apart from adjacent teeth by a distance substantially equal to the maximum width.

13. The dispenser of claim 1, and further comprising a latch for maintaining the divider in the second dispensing position.

* * * * *